US008768194B2

(12) United States Patent
Nakamura et al.

(10) Patent No.: US 8,768,194 B2
(45) Date of Patent: Jul. 1, 2014

(54) FIXING DEVICE, IMAGE FORMING APPARATUS, AND FIXING METHOD

(75) Inventors: Satoshi Nakamura, Kanagawa (JP); Yasuto Okabayashi, Kanagawa (JP); Toshiyuki Miyata, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 170 days.

(21) Appl. No.: 13/541,170

(22) Filed: Jul. 3, 2012

(65) Prior Publication Data

US 2013/0223865 A1 Aug. 29, 2013

(30) Foreign Application Priority Data

Feb. 24, 2012 (JP) ..... 2012-038862

(51) Int. Cl.
*G03G 15/20* (2006.01)

(52) U.S. Cl.
USPC ..... 399/69; 399/45; 399/92

(58) Field of Classification Search
CPC .. G03G 15/206; G03G 15/2017; G03G 15/20
USPC ..... 399/92, 406, 69, 45
See application file for complete search history.

(56) References Cited

U.S. PATENT DOCUMENTS

| | | | | |
|---|---|---|---|---|
| 5,561,512 | A | 10/1996 | Fukano et al. | |
| 2005/0238380 | A1 * | 10/2005 | Iijima et al. | 399/92 |
| 2007/0280721 | A1 * | 12/2007 | Kanai | 399/92 |

FOREIGN PATENT DOCUMENTS

| | | | |
|---|---|---|---|
| JP | 11-54242 | A | 2/1999 |
| JP | 3398500 | B2 | 4/2003 |
| JP | 2010-243852 | A | 10/2010 |

* cited by examiner

*Primary Examiner* — Susan Lee
(74) *Attorney, Agent, or Firm* — Sughrue Mion, PLLC

(57) ABSTRACT

A fixing device includes: a fixing unit that transports a recording medium as nipped between a pressure rotary member and a heating rotary member, to thereby fix a developer image on the recording medium; temperature detectors that detect temperatures of regions of the pressure rotary member; cooling units that cool the detected regions; and a controller that controls the cooling units to, if a temperature difference between the regions is more than a set temperature difference, execute first cooling for reducing the temperature difference to the set temperature difference or less, and to, if a width of the recording medium perpendicular to a transport direction thereof used in an immediately preceding image formation is equal to or less than a preset width, execute, subsequently to the first cooling, second cooling for cooling the pressure rotary member for a preset time.

6 Claims, 9 Drawing Sheets

FIG. 8

| SHEET CONDITIONS OF IMMEDIATELY PRECEDING PRINT JOB | | | STANDBY TIME OF NEXT PRINT JOB (SECONDS) |
|---|---|---|---|
| BASIS WEIGHT | SIZE | NUMBER OF PRINTS | |
| SMALL (LESS THAN 100 g/m$^2$) | B4S | 100 | 36 |
| | | 500 | 49 |
| | A4S | 100 | 27 |
| | | 500 | 39 |
| | B5S | 100 | 35 |
| | | 500 | 54 |
| | POSTCARD | 100 | 1 |
| | | 500 | 10 |
| MEDIUM (100 TO 200 g/m$^2$) | B4S | 100 | 72 |
| | | 500 | 88 |
| | A4S | 100 | 66 |
| | | 500 | 89 |
| | B5S | 100 | 65 |
| | | 500 | 98 |
| | POSTCARD | 100 | 25 |
| | | 500 | 50 |
| LARGE (MORE THAN 200 g/m$^2$) | B4S | 100 | 85 |
| | | 500 | 99 |
| | A4S | 100 | 85 |
| | | 500 | 109 |
| | B5S | 100 | 81 |
| | | 500 | 113 |
| | POSTCARD | 100 | 42 |
| | | 500 | 73 |

FIG. 10

| | | CONDITIONS OF NEXT PRINT JOB | | | | | | |
|---|---|---|---|---|---|---|---|---|
| | | BASIS WEIGHT | SMALL (LESS THAN 100 g/m$^2$) | | MEDIUM (100 TO 200 g/m$^2$) | | LARGE (MORE THAN 200 g/m$^2$) | |
| | BASIS WEIGHT | SIZE | A4S | A3L | A4S | A3L | A4S | A3L |
| CONDITIONS OF IMMEDIATELY PRECEDING PRINT JOB | SMALL (LESS THAN 100 g/m$^2$) | A4S | STANDBY TIME 0 | STANDBY TIME MEDIUM | STANDBY TIME 0 | STANDBY TIME SHORT | STANDBY TIME 0 | STANDBY TIME 0 |
| | | A3L | STANDBY TIME 0 | STANDBY TIME 0 | STANDBY TIME 0 | STANDBY TIME 0 | STANDBY TIME 0 | STANDBY TIME 0 |
| | MEDIUM (100 TO 200 g/m$^2$) | A4S | STANDBY TIME 0 | STANDBY TIME LONG | STANDBY TIME 0 | STANDBY TIME MEDIUM | STANDBY TIME 0 | STANDBY TIME 0 |
| | | A3L | STANDBY TIME 0 | STANDBY TIME 0 | STANDBY TIME 0 | STANDBY TIME 0 | STANDBY TIME 0 | STANDBY TIME 0 |
| | LARGE (MORE THAN 200 g/m$^2$) | A4S | STANDBY TIME 0 | STANDBY TIME LONG | STANDBY TIME 0 | STANDBY TIME MEDIUM | STANDBY TIME 0 | STANDBY TIME 0 |
| | | A3L | STANDBY TIME 0 | STANDBY TIME 0 | STANDBY TIME 0 | STANDBY TIME 0 | STANDBY TIME 0 | STANDBY TIME 0 |

FIXING DEVICE, IMAGE FORMING APPARATUS, AND FIXING METHOD

CROSS-REFERENCE TO RELATED APPLICATIONS

This application is based on and claims priority under 35 USC 119 from Japanese Patent Application No. 2012-038362 filed Feb. 24, 2012.

BACKGROUND (i) Technical Field

The present invention relates to a fixing device, an image forming apparatus, and a fixing method.

(ii) Related Art

In an image forming apparatus, such as a copier and a printer, a roller pair system or a belt system is known as a fixing device which fixes a toner image (developer image) on, for example, a sheet (recording medium). The roller pair system is configured by a heating roller (heating rotary member) and a pressure roller (pressure rotary member). The belt system is configured by a heating unit (heating rotary member), which is formed by a heating roller and an endless heating belt driven to rotate by the heating roller, and a pressure roller (pressure rotary member).

Further, the heating rotary member, such as the heating roller and the heating unit, is provided with a heater serving as a heating source.

In such a fixing device, a sheet having an unfixed toner image transferred thereto is sent to a fixing nip part formed between mutually facing portions of a roller pair or the like, and is applied with heat and pressure. Thereby, the toner image is fixed on the sheet.

In this process, the heat of the heating rotary member is also transmitted to the pressure roller. Thus, the pressure roller is thermally deformed.

SUMMARY

According to an aspect of the invention, there is provided a fixing device including a fixing unit, a plurality of temperature detectors, a plurality of cooling units, and a controller. The fixing unit includes a pressure rotary member and a heating rotary member which includes a heating source. The fixing unit transports a recording medium while nipping the recording medium between the pressure rotary member and the heating rotary member, to thereby cause a developer image transferred to the recording medium to be fixed on the recording medium. The plurality of temperature detectors detect temperatures of a plurality of regions of the pressure rotary member located along the axial direction of the pressure rotary member. The plurality of cooling units are provided to correspond to the plurality of temperature detectors, and cool the regions of the pressure rotary member subjected to the temperature detection by the corresponding plurality of temperature detectors. The controller controls the cooling units to, if a temperature difference between the regions of the pressure rotary member subjected to the detection by the plurality of temperature detectors is more than a set temperature difference which is a preset temperature difference, execute first cooling for reducing the temperature difference between the regions of the pressure rotary member to be equal to or less than the set temperature difference, and to, if a width of the recording medium perpendicular to a transport direction of the recording medium used in an immediately previously executed image formation is equal to or less than a preset width, execute, subsequently to the first cooling, second cooling for cooling the pressure rotary member for a preset time.

BRIEF DESCRIPTION OF THE DRAWINGS

An exemplary embodiment of the present invention will be described in detail based on the following figures, wherein:

FIG. 8 is a diagram illustrating an example of a table referred to in the execution of the flowchart of FIG. 7;

FIG. 10 is a diagram illustrating an example of a table referred to in the execution of the flowchart of FIG. 9.

DETAILED DESCRIPTION

Figure 1:
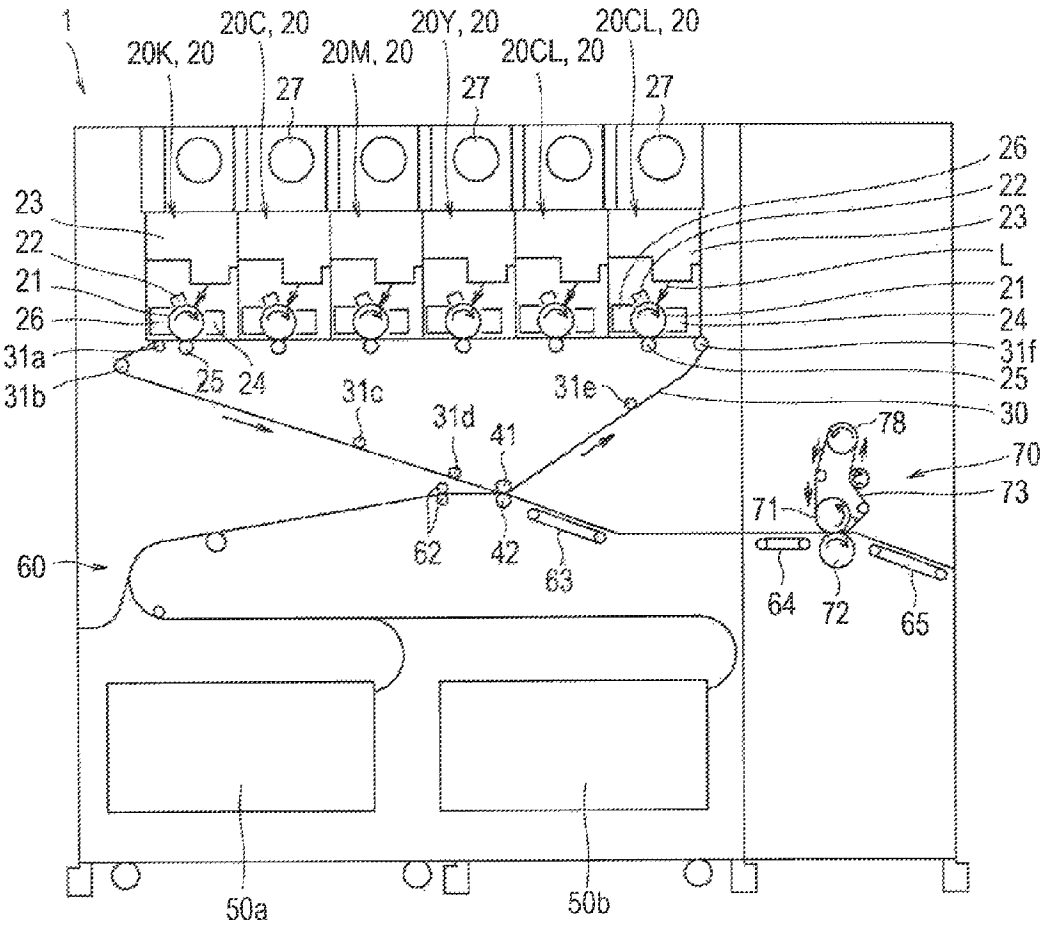
FIG. 1 is a conceptual diagram illustrating an example of an image forming apparatus according to an exemplary embodiment of the invention.

An exemplary embodiment as an example of the present invention will be described in detail below on the basis of the drawings. In the drawings for describing the exemplary embodiment, identical constituent elements will basically be designated by identical reference numerals, and repetitive description thereof will be omitted.

FIG. 1 is a conceptual diagram of an example of an image forming apparatus 1 according to an exemplary embodiment of the invention.

The image forming apparatus 1 of the present exemplary embodiment is a tandem-type color printer, for example, and includes plural image forming units 20, an intermediate transfer belt (an example of an image holding member) 30, a pair of a backup roller 41 and a second transfer roller (an example of a transfer unit) 42, sheet supply trays 50*a* and 50*b*, a sheet transport system 60, and a fixing device 70.

The image forming units 20 include image forming units 20Y, 20M, 20C, and 20K for four colors, which form toner images of yellow, magenta, cyan, and black colors, for example, and image forming units 20CL and 20CL for transparent colors, which transfer toner images of transparent colors, for example. The six image forming units 20CL, 20CL, 20Y, 20M, 20C, and 20K are arranged in the order of transparent, transparent, yellow, magenta, cyan, and black colors along the rotation direction of the intermediate transfer belt 30 such that the toner images formed in accordance with image information of the respective colors are first-transferred to the intermediate transfer belt 30. The image forming units 20CL and 20CL for the transparent colors may be replaced by image forming units for light colors, which transfer toner images of light colors, such as light yellow, light magenta, light cyan, and light black, for example. Further, an image forming unit 20CL for a transparent color and an image forming unit for a light color may both be provided side by side.

Each of the image forming units 20 includes a photoconductor drum (an example of an image holding member) 21, a charging device 22 which charges a surface of the photoconductor drum 21 to a specified potential, an exposure device 23 which radiates laser light L onto the charged photoconductor drum 21 to thereby form an electrostatic latent image, a developing device 24 which develops the electrostatic latent image formed on the photoconductor drum 21 by the exposure device 23 to thereby form a toner image, a first transfer roller 25 which transfers the toner image on the photoconductor drum 21 to the intermediate transfer belt 30 in a first transfer section, and a drum cleaner 26 which removes residual toner and paper dust from the surface of the photoconductor drum 21 after the transfer of the toner image. Above each of the image forming units 20, a toner cartridge 27 is disposed which supplies a developer to the developing device 24.

In each of the image forming units 20, the first transfer roller 25 is disposed such that the intermediate transfer belt 30 is nipped between the first transfer roller 25 and the photoconductor drum 21. Further, the first transfer roller 25 is applied with a transfer bias voltage opposite in polarity to a toner charging electrode. Thereby, an electric field is formed between the photoconductor drum 21 and the first transfer roller 25, and the toner image charged on the photoconductor drum 21 is transferred to the intermediate transfer belt 30 by the Coulomb force. The photoconductor drum 21 rotates in the clockwise direction in the first transfer.

The above-described intermediate transfer belt 30 is a member on which the toner images of the respective color components formed by the image forming units 20 are sequentially transferred (first-transferred) and held. The intermediate transfer belt 30 is formed into an endless shape as stretched over plural support rollers 31*a* to 31*f* and the backup roller 41. While rotating in a counterclockwise circumferential direction, the intermediate transfer belt 30 is subjected to the first transfer of the toner images formed by the image forming units 20CL, 20CL, 20Y, 20M, 20C, and 20K for the respective colors.

The above-described pair of the backup roller 41 and the second transfer roller 42 serves as a mechanical unit for forming a full-color image by causing the toner images multiply transferred onto the intermediate transfer belt 30 to be batch-transferred (second-transferred) to a sheet (an example of a recording medium) or the like. The backup roller 41 and the second transfer roller 42 are disposed to face each other across the intermediate transfer belt 30. Mutually facing portions of the backup roller 41 and the second transfer roller 42 form a second transfer section.

The backup roller 41 is rotatably disposed on the inner surface side of the intermediate transfer belt 30, and the second transfer roller 42 is rotatably disposed as facing a toner image transfer surface of the intermediate transfer belt 30. The backup roller 41 and the second transfer roller 42 are disposed such that respective rotation axis directions thereof (directions perpendicular to the drawing plane of FIG. 1) are parallel to each other.

In the transfer of the toner image on the intermediate transfer belt 30, the backup roller 41 is applied with a voltage having a polarity the same as a toner charging polarity, or the second transfer roller 42 is applied with a voltage having a polarity opposite to the toner charging polarity. Thereby, a transfer electric field is formed between the backup roller 41 and the second transfer roller 42, and the toner image held on the intermediate transfer belt 30 is transferred onto the sheet.

The above-described sheet supply trays 50*a* and 50*b* store sheets or the like (hereinafter simply referred to as the sheets) of various sizes and thicknesses. A sheet in the sheet supply tray 50*a* or 50*b* is drawn by a pickup roller (not illustrated) of the sheet transport system 60. Thereafter, the sheet is introduced into the second transfer section with controlled timing by registration rollers 62 of the sheet transport system 60, and the toner image is transferred to the sheet. Further, thereafter, the sheet is transported to the fixing device 70 via transport belts 63 and 64 of the sheet transport system 60.

The fixing device 70 is a device which causes the unfixed toner image transferred to the sheet in the second transfer section to be fixed on the sheet by thermo-compression bonding. The fixing device 70 includes a fixing unit formed by a heating unit (an example of a heating rotary member) 78 including a heating roller 71 and a heating belt 73 and a pressure roller (an example of a pressure rotary member) 72 provided to face the heating unit 78. Further, the heating belt 73 is provided to pass a fixing nip part between the heating roller 71 and the pressure roller 72.

The sheet subjected to the second transfer is transported to the fixing nip part between mutually facing portions of the heating roller 71 and the pressure roller 72, and is discharged as nipped between the heating belt 73 and the pressure roller 72. In this process, the sheet is heated by the heating roller 71 and the heating belt 73, and is applied with pressure by the pressure roller 72. Thereby, the toner image is fixed on the sheet. The sheet having passed the fixing device 70 is sent to discharge rollers (not illustrated) via a transport belt 65, and is discharged outside the image forming apparatus 1.

Figure 2:
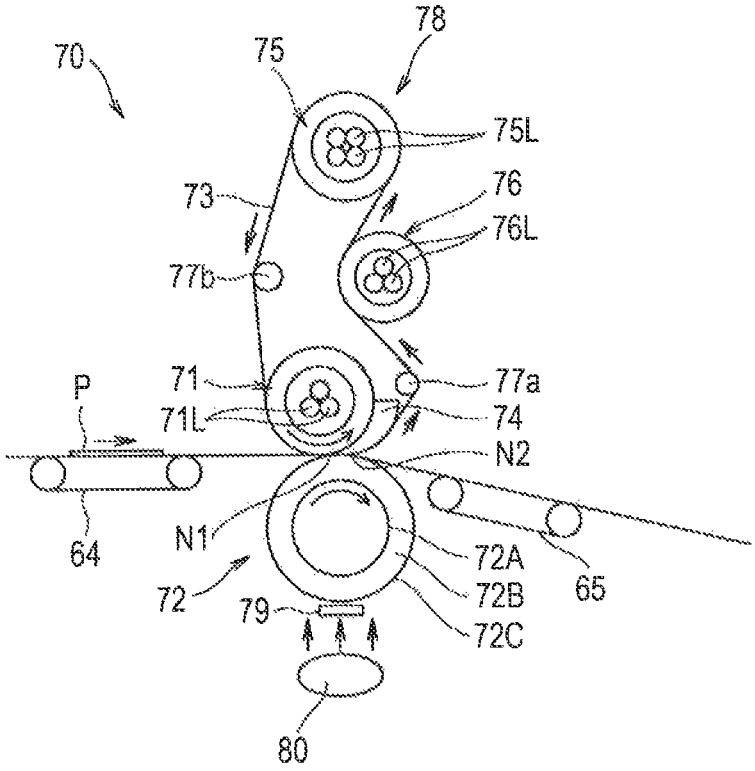
FIG. 2 is a conceptual diagram illustrating an example of a fixing device of the image forming apparatus in FIG. 1.

Subsequently, a configuration of the above-described fixing device 70 will be described with reference to FIGS. 2 and 3.

In addition to the above-described heating unit 78 as an example of the heating rotary member including the heating roller 71 and the heating belt 73 and the above-described pressure roller 72, the fixing device 70 includes a peeling pad 74, an internal heating roller 75, an external heating roller 76, support rollers 77*a* and 77*b*, temperature sensors (each an example of a temperature detector) 79, and cooling fans (each an example of a cooling unit) 80.

The heating roller 71 is a member which is driven to rotate the pressure roller 72 and the heating belt 73 by receiving drive force of a motor (not illustrated), and is disposed to be rotatable in the counterclockwise direction. In accordance with the rotation of the heating roller 71, a sheet P is transported, and the pressure roller 71 and the heating belt 73 (are driven to) rotate. A first fixing nip part N1 is formed between the heating roller 71 and the pressure roller 72.

The heating roller 71 is also a member which heats the sheet P and the heating belt 73. The heating roller 71 is made of a metal, such as aluminum, iron, or stainless steel, for example, and includes therein three heating sources (each an example of a heating source) 71L, such as halogen lamps, for example. The number of the heating sources 71L, however, may be two or less, or may be four or more.

On one side (downstream side in the transport of the sheet P) of the heating roller 71, the above-described peeling pad 74 is disposed to be adjacent to the entire area of the heating roller 71 in the axial direction thereof. The peeling pad 74 has a function of peeling, from the heating belt 73, the sheet P subjected to the fixing process. Further, a second fixing nip part N2 is formed between the peeling pad 74 and the pressure roller 72. Accordingly, the fixing nip part of the fixing device 70 is longer than in a configuration not including the peeling pad 74.

Between the thus configured heating roller 71 and peeling pad 74 and the heating belt 73, oil is interposed. This configuration reduces contact resistance between the heating roller 71 and the heating belt 73 and between the peeling pad 74 and the heating belt 73, and thus smoothes the rotational movement of the heating belt 73. This configuration further suppresses or prevents damage of the heating belt 73 attributed to a contact between the heating roller 71 and the separating belt 73 or between the peeling pad 74 and the heating belt 73.

The above-described pressure roller 72 includes a hollow cylindrical core bar 72A, an elastic layer 72B covering the outer circumference of the core bar 72A, and a release layer 72C covering the outer circumference of the elastic layer 72B. The core bar 72A is made of a metal, such as aluminum, iron, or stainless steel, for example. The elastic layer 72B is made of a heat-resistant insulating material, such as a silicone rubber, for example. The release layer 72C is made of a fluorine-based resin, for example.

The pressure roller 72 is disposed to be movable in a direction approaching the heating roller 71 and a direction separating from the heating roller 71. In the fixing process, the pressure roller 72 is pressed against the heating roller 71 by a resilient member (spring). Thereby, the above-described first and second fixing nip parts N1 and N2 are formed between the mutually facing portions of the heating roller 71 and the pressure roller 72 and between the mutually facing portions of the peeling pad 74 and the pressure roller 72, respectively.

The above-described heating belt 73 is formed by an endless belt which includes a heat-resistant insulating substrate made of a material such as a polyimide resin, for example, and a release layer made of a fluorine-based resin, for example, and laminated over the substrate. The heating belt 73 is provided to be rotatable in a circumferential direction (counterclockwise direction), as stretched over the heating roller 71, the internal heating roller 75, and the support rollers 77*a* and 77*b*.

The heating belt 73 is stretched over the rollers to pass the above-described first and second fixing nip parts N1 and N2. The sheet P transported to the first and second fixing nip parts N1 and N2 is heated by the heating roller 71 and the heating belt 73 and applied with pressure by the pressure roller 72, as nipped between the heating belt 73 and the pressure roller 72. Thereby, the unfixed toner image on the sheet P is fixed on the sheet P. If the thus configured heating belt 73 is used, a reduction in heating temperature is suppressed as compared with a case where the sheet P is heated only by a heating roller with no use of the heating belt 73. Further, the width of the heating belt 73 is allowed to be greater than the sheet size, and thus the occurrence of a difference in gloss is also suppressed or prevented.

The above-described internal heating roller 75 is a member which heats the heating belt 73. At a position more distant from the pressure roller 72 than the heating roller 71 and the external heating roller 76 are, the internal heating roller 75 is rotatably disposed to be driven in accordance with the rotation of the heating belt 73.

The internal heating roller 75 is made of a metal, such as aluminum, iron, or stainless steel, for example, and includes therein four heating sources (each an example of a heating source) 75L, such as halogen lamps, for example. The number of the heating sources 75L, however, may be three or less, or may be five or more.

The above-described external heating roller 76 is a member which heats the heating belt 73, and is disposed between the heating roller 71 and the internal heating roller 75 and outside a loop of the heating belt 73 to be in contact with the heating belt 73 so as to press the heating belt 73 toward the inside of the loop. Further, the external heating roller 76 is also rotatably disposed to be driven in accordance with the rotation of the heating belt 73.

The external heating roller 76 is made of a metal, such as aluminum, iron, or stainless steel, for example, and includes therein three heating sources (each an example of a heating source) 76L, such as halogen lamps, for example. The number of the heating sources 76L, however, may be two or less, or may be four or more.

The temperature sensors (each an example of a temperature detector) 79 for detecting surface temperatures of the pressure roller 72 are provided outside the pressure roller 72. In the exemplary embodiment, a non-contact sensor, such as an infrared sensor, is used as each of the temperature sensors 79. The detected surface temperatures of the pressure roller 72 are transmitted to a later-described central processing unit (CPU) 83. Further, the cooling fans (each an example of a cooling unit) 80 for cooling the pressure roller 72 are provided outside the pressure roller 72.

Figure 3:
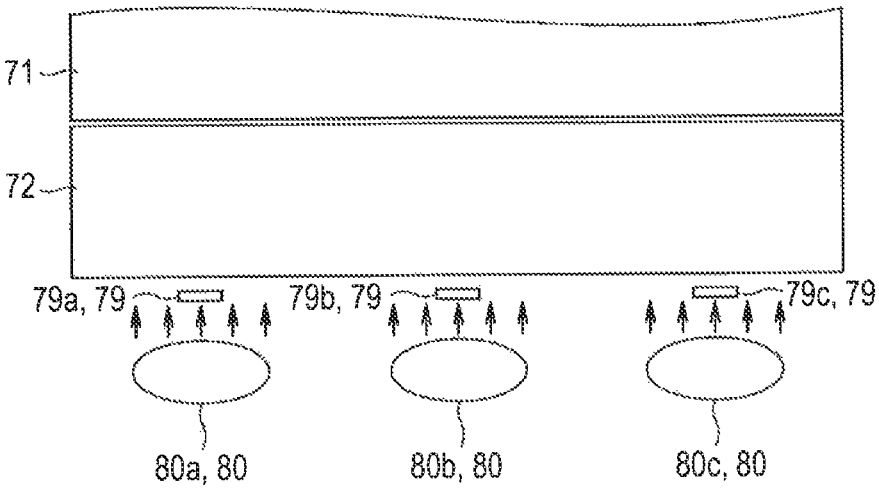
FIG. 3 is a conceptual diagram illustrating major parts of the fixing device in FIG. 2.

As illustrated in FIG. 3, the number of the temperature sensors 79 provided along the axial direction of the pressure roller 72 is three. In the drawing, a temperature sensor 79*a* detects the temperature of a left side portion of the pressure roller 72, and a temperature sensor 79*b* detects the temperature of a central portion of the pressure roller 72. Further, a temperature sensor 79*c* detects the temperature of a right side portion of the pressure roller 72.

To correspond to the thus configured temperature sensors 79*a*, 79*b*, and 79*c*, the number of the above-described cooling fans 80 is set to three (i.e., cooling fans 80*a*, 80*b*, and 80*c*). Thereby, respective regions of the pressure roller 72 corresponding to the temperature sensors 79*a*, 79*b*, and 79*c* are cooled.

The number of the temperature sensors 79*a*, 79*b*, and 79*c* and the corresponding cooling fans 80*a*, 80*b*, and 80*c*, however, may be any other plural number, and thus may be two, or may be four or more. Further, in the exemplary embodiment, the temperature sensors 79*a*, 79*b*, and 79*c* and the cooling fans 80*a*, 80*b*, and 80*c* are arranged in the axial direction of the pressure roller 72. However, the temperature sensors 79*a*, 79*b*, and 79*c* and the cooling fans 80*a*, 80*b*, and 80*c* are not necessarily required to be arranged along the axial direction, as long as the temperature detection and the cooling are performed on the intended regions of the pressure roller 72 (herein, the left side portion, the central portion, and the right side portion of the pressure roller 72).

Figure 4:
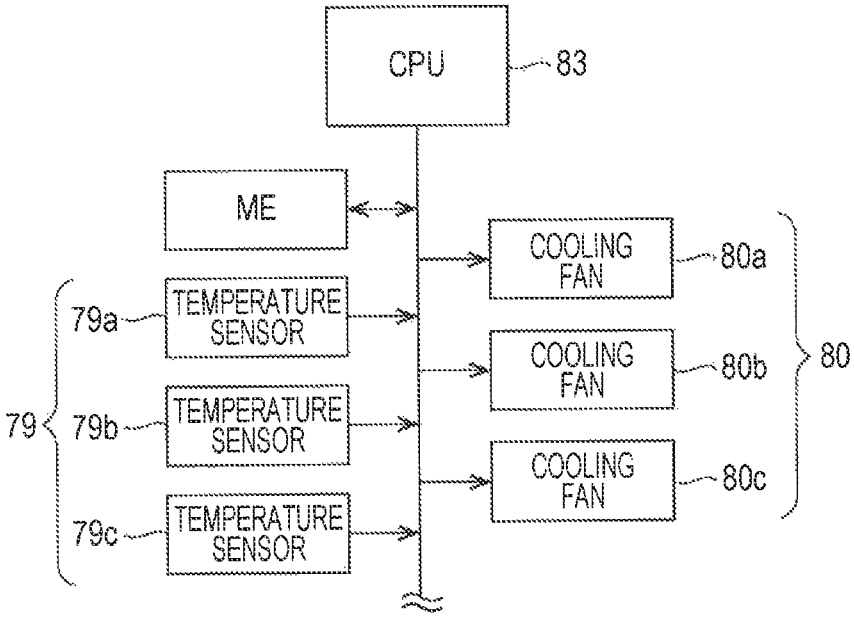
FIG. 4 is a circuit block diagram of major parts of the image forming apparatus in FIG. 1.

FIG. 4 illustrates a circuit block diagram of major parts of the above-described image forming apparatus 1.

The CPU (an example of a controller) 83 is a device which controls image processing of the image forming apparatus 1. The CPU 83 is electrically connected to a memory (an example of a storage unit) ME, and is also electrically connected to the above-described temperature sensors 79 and cooling fans 80 and so forth.

In the fixing process of the fixing device 70, the CPU 83 controls the cooling fans 80*a*, 80*b*, and 80*c* on the basis of the surface temperatures of the pressure roller 72 detected by the respective temperature sensors 79*a*, 79*b*, and 79*c* and later-described matters, to thereby cool the pressure roller 72.

Herein, a temperature control of the pressure roller 72 will be described.

As described above, the pressure roller 72 is pressed against the heating roller 71. Therefore, the heat of the heating sources 71L, 75L, and 76L of the heating unit 78 is conducted to the pressure roller 72. Thereby, the pressure roller 72 is also heated, and is thermally deformed accordingly.

A mode of the thermal deformation will be specifically described.

When the pressure roller 72 is viewed in the axial direction thereof, the heat is absorbed by the sheet P in an area passed by the sheet P but not in an area not passed by the sheet P. Therefore, a difference in temperature, i.e., a difference in thermal expansion is generated in the axial direction of the pressure roller 72, and the diameter of the pressure roller 72 varies in the axial direction.

For example, in the image forming apparatus 1 which is capable of performing the image formation in a size up to the size of an A3-size sheet P set in a direction of increasing the transport width thereof (A3L), and which transports the sheet P with the center of a sheet transport path in the width direction thereof set to the center of the sheet width, after the image formation (print job) is performed in the size of an A4-size sheet P set in a direction of reducing the transport width thereof (A4S), the temperature is higher in the opposite end portions of the pressure roller 72 in the axial direction not passed by the sheet P than in the central portion of the pressure roller 72 in the axial direction, which is the area passed by the sheet P. Therefore, the diameter of the pressure roller 72 is greater in the opposite end portions in the axial direction, in which the temperature is higher.

Further, if a sheet P to be subjected to the next image formation has a size covering the areas different in the diameter of the pressure roller 72 in the axial direction, such as the size A3L, for example, and if the sheet P is transported to fix the toner image thereon at the first and second fixing nip parts N1 and N2, a crease, a fold line, or the like may be formed in the sheet P, i.e., the sheet P may be damaged.

In this case, it is desired to cool the pressure roller 72 by using the cooling fans 80 to reduce the temperature difference between the central portion and each of the end portions of the pressure roller 72 to be equal to or less than a preset temperature difference (set temperature difference).

However, the cooling fans 80 cool the surface of the pressure roller 72, and thus the difference in expansion remains inside the pressure roller 72 in some cases.

Figure 5:
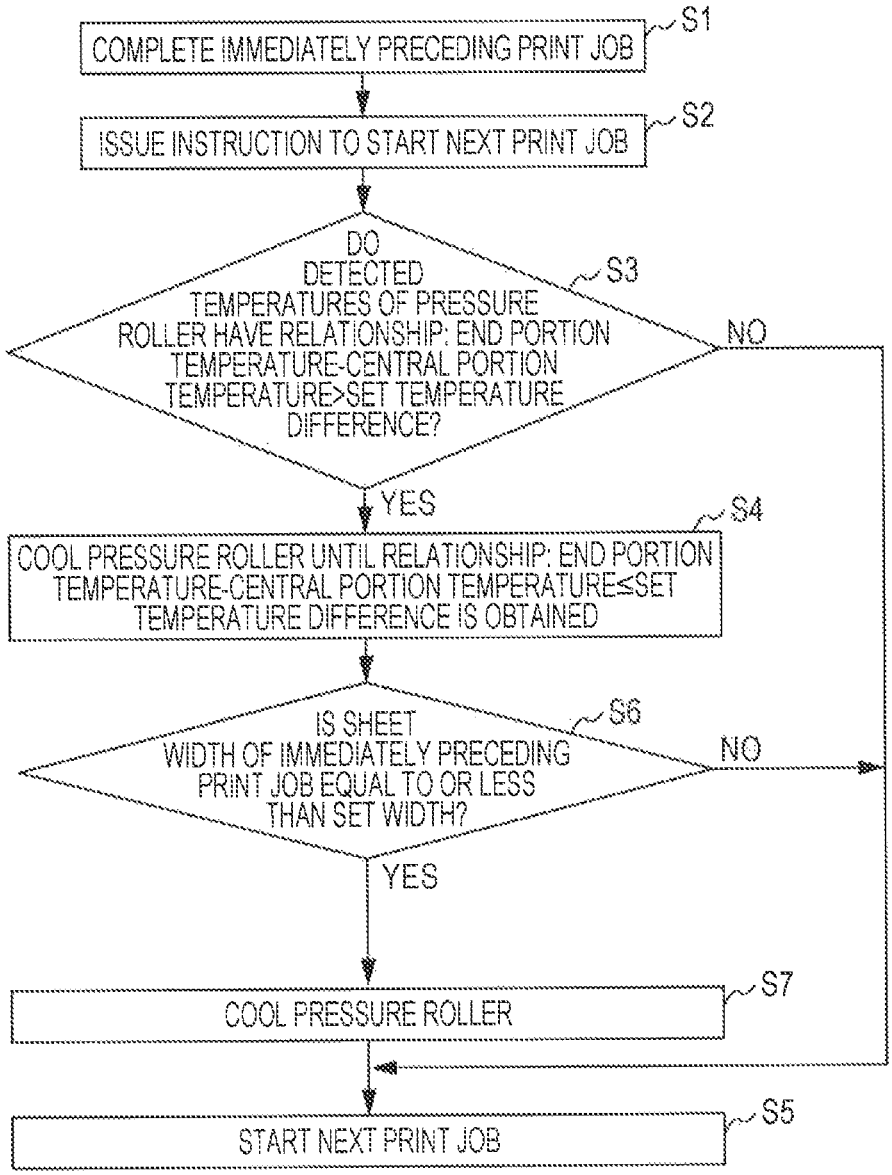
FIG. 5 is a flowchart illustrating an example of a cooling operation performed on a pressure roller of the fixing device according to the exemplary embodiment of the invention.

In the exemplary embodiment, therefore, the CPU 83 cools the pressure roller 72 via the cooling fans 80 as in the flowchart illustrated in FIG. 5.

That is, in FIG. 5, if an immediately preceding print job is completed (step S1), and if an instruction to start the next print job is issued (step S2), the temperature detection is performed in the axial direction of the pressure roller 72 with the use of the temperature sensors 79*a*, 79*b*, and 79*c*, and the temperature difference between the temperature of each of the end portions and the temperature of the central portion is calculated (step S3).

Then, if the calculated temperature difference is more than the set temperature difference at step S3, the CPU 83 executes, as first cooling, cooling of the pressure roller 72 until the temperature difference therebetween is reduced to be equal to or less than the set temperature difference (step S4). Herein, the temperature is higher in the end portions. Therefore, the CPU 83 performs a control to rotate the cooling fans 80*a* and 80*c* and stop the cooling fan 80*b*. Meanwhile, if the calculated temperature difference is equal to or less than the set temperature difference at step S3, the CPU 83 immediately starts the next print job without executing the cooling of the pressure roller 72 by the cooling fans 80 (step S5).

If the cooling of the pressure roller 72 at step S4 (first cooling) is executed, a determination is then made of whether or not the width of the sheet P perpendicular to the transport direction of the recording medium P (sheet width) used in the immediately previously executed print job is equal to or less than a preset width (set width) (step S6).

That is, the first cooling cools the surface of the pressure roller 72, and thus the difference in expansion inside the pressure roller 72 remains, even if the difference in surface temperature is reduced to be equal to or less than the set temperature difference. Therefore, the diameter of the pressure roller 72 still varies in the axial direction thereof. That is, the diameter is greater in the opposite end portions than in the central portion in the axial direction.

Specifically, if the sheet width in the immediately previously executed print job corresponds to the size A4S, for example, the diameter is greater in the areas of the opposite end portions in the axial direction not passed by the A4S-size sheet P than in the area of the central portion in the axial direction passed by the A4S-size sheet P. If the next image formation is to be performed on a sheet P of a size equal to or smaller than the size A4S, therefore, the sheet P will not pass the area corresponding to the increased diameter, and thus will not cause a problem. If the next image formation is to be performed on a sheet P of a size larger than the size A4S, however, the sheet P will pass the area corresponding to the increased diameter, and thus will cause a problem.

In view of the above, whether or not the sheet width used in the immediately previously executed print job is equal to or less than the set width is determined at step S6.

Then, if the sheet width is equal to or less than the set width, the CPU 83 executes, as second cooling, cooling of the pressure roller 72 for a preset time (step S7). The second cooling is executed subsequently to the first cooling. Further, the second cooling is intended to eliminate the difference in expansion remaining inside the pressure roller 72. Similarly as in the first cooling, therefore, the cooling fans 80*a* and 80*c* are rotated, and the cooling fan 80*b* is stopped.

Then, if the cooling of the pressure roller 72 at step S7 (second cooling) is executed, the difference in expansion in the axial direction of the pressure roller 72 remaining inside the pressure roller 72 is eliminated. Therefore, the next print job is started (step S5).

The flow illustrated in FIG. 5 is stored in the memory ME illustrated in FIG. 4. Later-described flows (FIGS. 7 and 9) are also stored in the memory ME.

With the cooling fans 80 thus controlled by the CPU 83, damage on the sheet P occurring during the transport owing to thermal deformation of the pressure roller 72 provided in the fixing device 70 is prevented.

Figure 6:
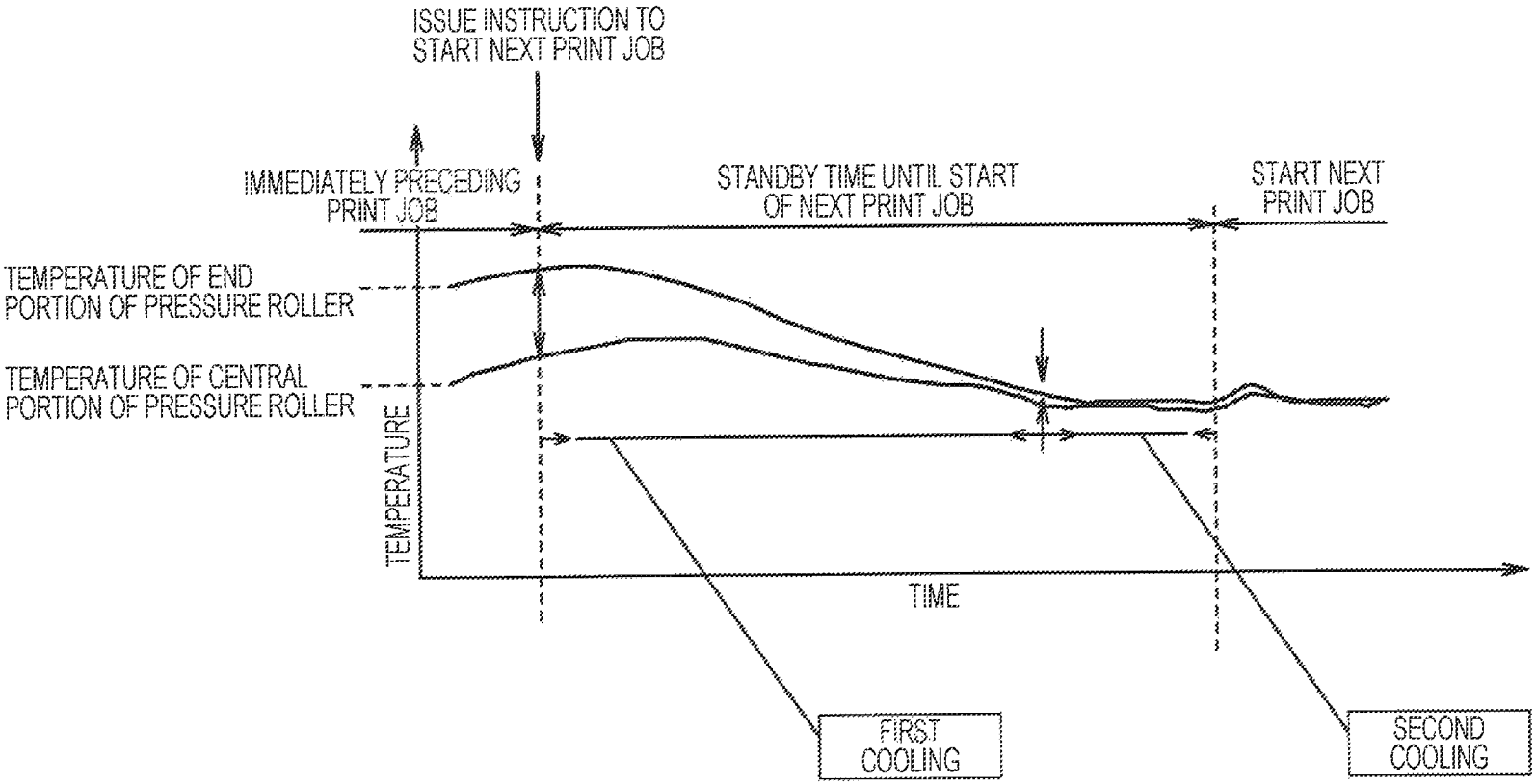
FIG. 6 is graphs illustrating changes in temperature occurring in the cooling operation performed on the pressure roller of the fixing device according to the exemplary embodiment of the invention.

FIG. 6 illustrates changes in temperature in the axial direction of the pressure roller 72 according to the above-described control.

Figure 7:
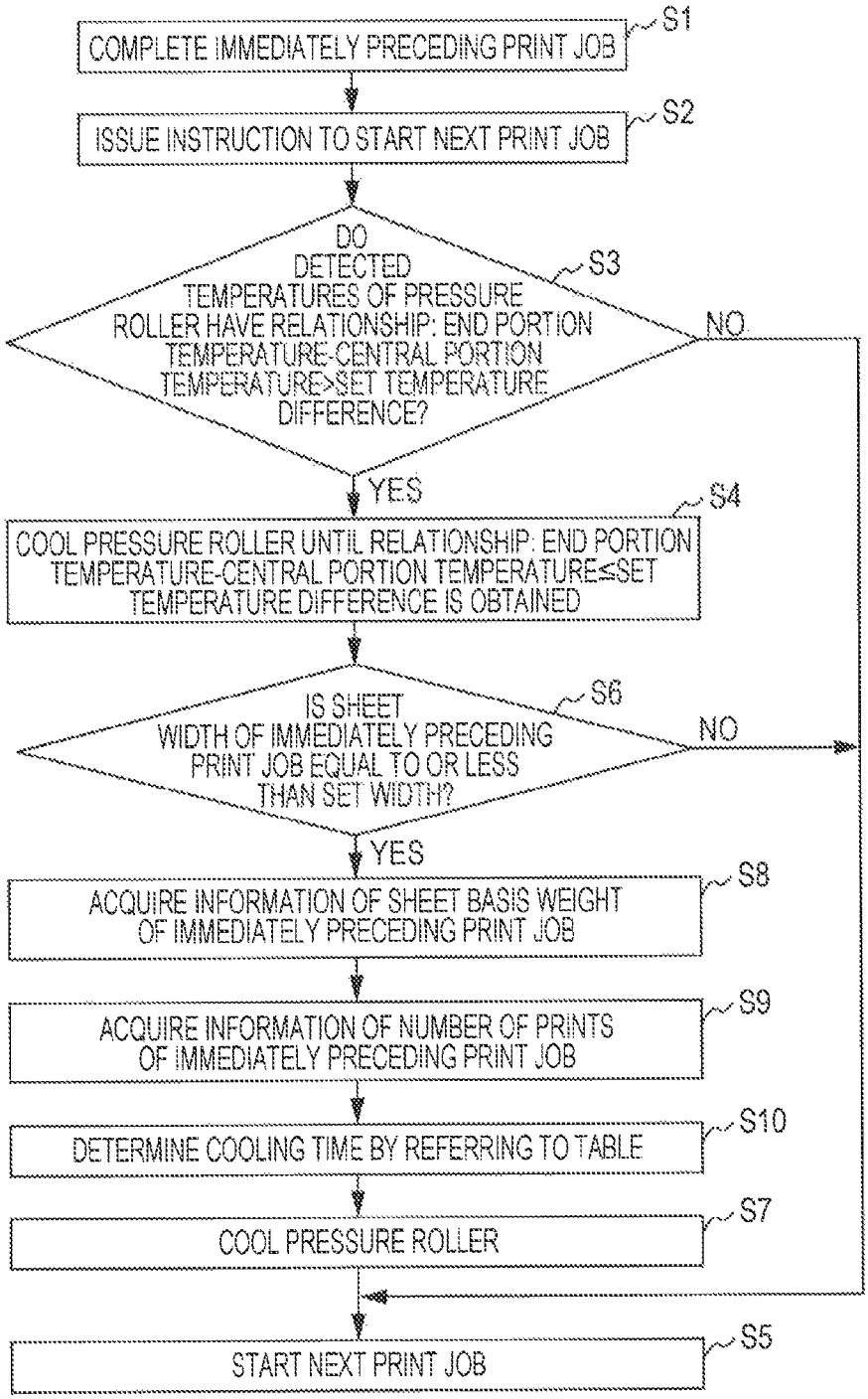
FIG. 7 is a flowchart illustrating another example of the cooling operation performed on the pressure roller of the fixing device according to the exemplary embodiment of the invention.

Herein, in the second cooling by the CPU 83, the execution time thereof (standby time of the next print job) may be controlled on the basis of the basis weight of the sheet P and the number of prints used in the immediately previously executed print job. FIG. 7 illustrates a flow of such a control. In the following description, repetitive description of parts common to those of FIG. 5 will be omitted.

That is, if the sheet width used in the immediately previously executed print job is equal to or less than the set width at step S6, the CPU 83 acquires the information of the basis weight of the sheet P used in the immediately previously executed print job (step S8), and further acquires the information of the number of prints of the sheets P used in the immediately previously executed print job (step S9). Then, the CPU 83 reads a table (FIG. 8) stored in the memory ME, and determines the execution time of the second cooling with reference to the table (step S10).

As illustrated in FIG. 8, if the basis weight or the sheet width of the sheet P is reduced, the amount of heat absorbed by the sheet P is reduced. Further, if the number of prints is reduced, the amount of heat absorbed by the sheet P is reduced. Thereby, the difference in the diameter of the pressure roller 72 in the axial direction thereof is reduced. Therefore, the execution time of the second cooling as the standby time of the next print job is reduced.

With this configuration, the execution time of the second cooling is more appropriately set on the basis of the information of the immediately previously executed print job.

In FIG. 7, the execution time of the second cooling is controlled on the basis of the basis weight of the sheet P and the number of prints used in the immediately previously executed print job. The control, however, may be performed on the basis of either one of the basis weight of the sheet P and the number of prints.

Figure 9:
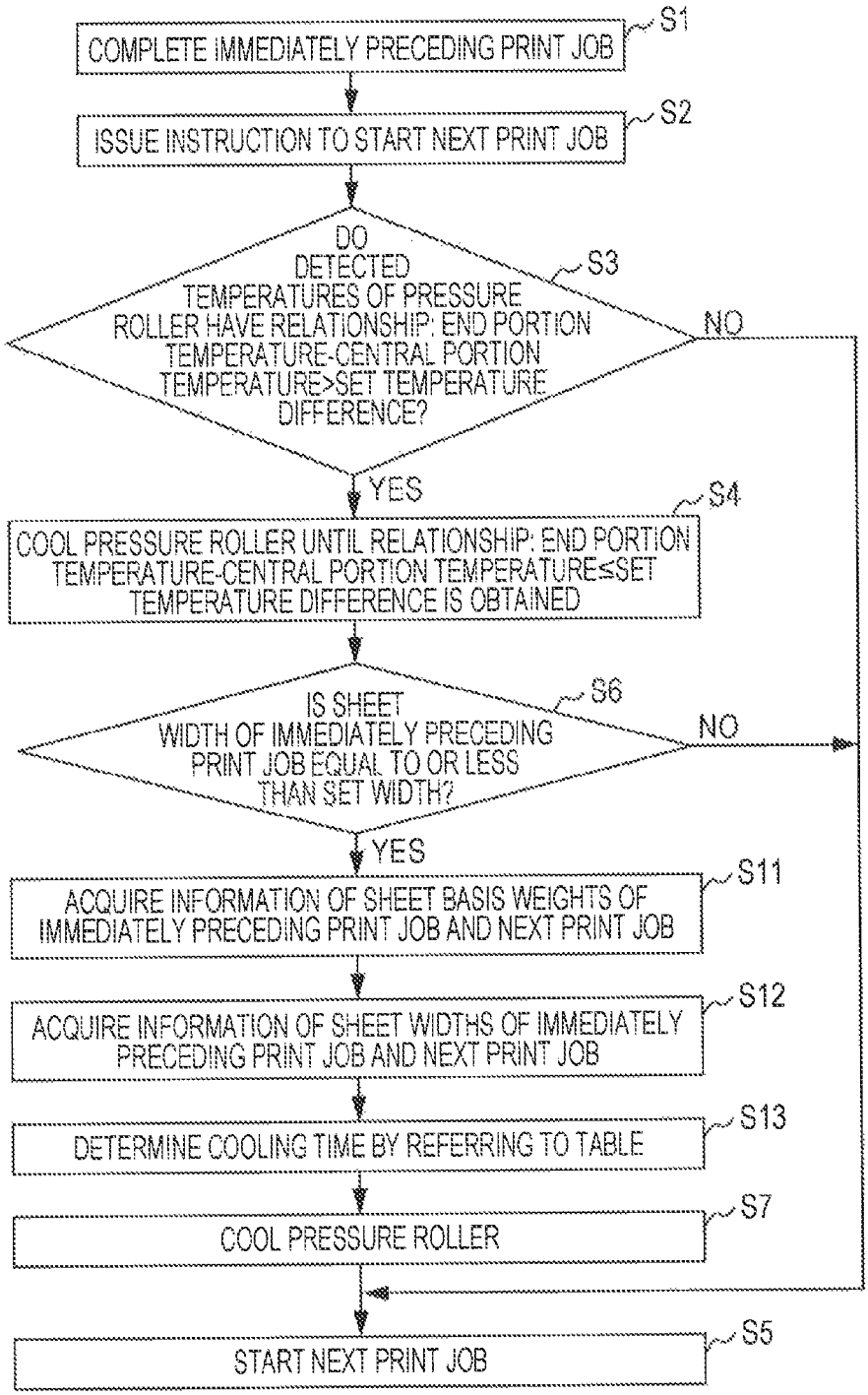
FIG. 9 is a flowchart illustrating another example of the cooling operation performed on the pressure roller of the fixing device according to the exemplary embodiment of the invention.

Further, in the second cooling by the CPU 83, the execution time thereof (standby time of the next print job) may be controlled on the basis of the basis weight of the sheet P and the sheet width of the sheet P (the width of the sheet P perpendicular to the transport direction of the recording medium P) used in the print job to be executed next. FIG. 9 illustrates a flow of such a control. In FIG. 9, the control is based on the basis weight and the sheet width of the sheet P used in the immediately previously executed print job, in addition to the basis weight and the sheet width of the sheet P used in the print job to be executed next. Also in the following description, repetitive description of parts common to those of FIGS. 5 and 7 will be omitted.

That is, if the sheet width used in the immediately previously executed print job is equal to or less than the set width at step S6, the CPU 83 acquires the information of the basis weight of the sheet P used in the immediately previously executed print job and the basis weight of the sheet P used in the print job to be executed next (step S11), and further acquires the information of the sheet width of the sheet P used in the immediately previously executed print job and the sheet width of the sheet P used in the print job to be executed next (step S12). Then, the CPU 83 reads a table (FIG. 10) stored in the memory ME, and determines the execution time of the second cooling with reference to the table (step S13).

As illustrated in FIG. 10, if the basis weight of the sheet P used in the immediately previously executed print job is reduced, the amount of heat absorbed by the sheet P is reduced, and the difference in the diameter of the pressure roller 72 in the axial direction thereof is reduced. Therefore, the execution time of the second cooling as the standby time of the next print job is reduced.

Further, if the basis weight of the sheet P used in the print job to be executed next is reduced, the influence of the difference in the diameter of the pressure roller 72 in the axial direction thereof is increased. Therefore, the execution time of the second cooling for reducing the difference is increased.

Further, if the sheet P used in the immediately previously executed print job has a small sheet width and the sheet P used in the print job to be executed next has a large sheet width, the execution time of the second cooling is generated. Further, if the difference between the sheet width of the sheet P used in the immediately previously executed print job and the sheet width of the sheet P used in the print job to be executed next is increased, the execution time of the second cooling is increased.

With this configuration, the execution time of the second cooling is more appropriately set on the basis of the information of the print job to be executed next.

In FIG. 9, the execution time of the second cooling is controlled on the basis of the basis weight and the sheet width of the sheet P used in the print job to be executed next and the basis weight and the sheet width of the sheet P used in the immediately previously executed print job. However, it suffices if the control is based on the basis weight and the sheet width of the sheet P used in the print job to be executed next. Further, the control may be performed not on the basis of both of the basis weight and the sheet width of the sheet P used in the print job to be executed next, but on the basis of either one thereof. Further, these controls may be combined with the control illustrated in FIG. 5 or FIG. 7.

The invention made by the present inventors has been specifically described above on the basis of the exemplary embodiment. However, it is to be understood that the exemplary embodiment disclosed in the present specification is illustrative in all aspects and is not limited to the disclosed techniques. That is, the technical scope of the present invention is not to be restrictively construed on the basis of the foregoing description of the exemplary embodiment, but is to be construed in accordance with the description of the claims, and includes techniques equivalent to the techniques described in the claims and all modifications not departing from the gist of the claims.

For example, in the foregoing description, the fixing device 70 is configured by the endless heating belt 73 driven to rotate by the heating roller 71 and the pressure roller 72. For example, however, the heating roller 71 may be used as the heating rotary member. Further, a belt system configured by a pressure roller and an endless belt may be used as the pressure rotary member.

Further, the numerical values and grouping illustrated in FIG. 8 and the numerical values and grouping illustrated in FIG. 10 may not accord with those of the exemplary embodiment. Further, conceptual lengths of the standby time illustrated in FIG. 10 ("short," "medium," and "long") are freely set to specific numerical values.

The foregoing description illustrates the application of the image forming apparatus to a second transfer system using an intermediate transfer belt. The image forming apparatus, however, may be applied to a direct transfer system which directly transfers an image on an image holding member to a recording medium.

What is claimed is:

1. A fixing device comprising:

a fixing unit that includes a pressure rotary member and a heating rotary member which includes a heating source, and that transports a recording medium while nipping the recording medium between the pressure rotary member and the heating rotary member, to thereby cause a developer image transferred to the recording medium to be fixed on the recording medium;

a plurality of temperature detectors that detect temperatures of a plurality of regions of the pressure rotary member located along the axial direction of the pressure rotary member;

a plurality of cooling units that are provided to correspond to the plurality of temperature detectors, and that cool the regions of the pressure rotary member subjected to the temperature detection by the corresponding plurality of temperature detectors; and a controller that controls the cooling units to, if a temperature difference between the regions of the pressure rotary member subjected to the detection by the plurality of temperature detectors is more than a set temperature difference which is a preset temperature difference, execute first cooling for reducing the temperature difference between the regions of the pressure rotary member to be equal to or less than the set temperature difference, and to, if a width of the recording medium perpendicular to a transport direction of the recording medium used in an immediately previously executed image formation is equal to or less than a preset width, execute, subsequently to the first cooling, second cooling for cooling the pressure rotary member for a preset time.

2. The fixing device according to claim 1, wherein, on the basis of at least one of the basis weight of the recording medium and the number of images to be formed used in the immediately previously executed image formation, the controller controls an execution time of the second cooling executed by the cooling units.

3. The fixing device according to claim 1, wherein, on the basis of at least one of the basis weight of the recording medium and the width of the recording medium perpendicular to the transport direction of the recording medium used in an image formation to be executed next, the controller controls an execution time of the second cooling executed by the cooling units.

4. The fixing device according to claim 2, wherein, on the basis of at least one of the basis weight of the recording medium and the width of the recording medium perpendicular to the transport direction of the recording medium used in an image formation to be executed next, the controller controls the execution time of the second cooling executed by the cooling units.

5. An image forming apparatus comprising:

an image holding member that holds a developer image;

a transfer unit that transfers to a recording medium the developer image held by the image holding member; and the fixing device according to claim 1 that fixes on the recording medium the developer image transferred to the recording medium and unfixed thereon.

6. A fixing method comprising:

transporting a recording medium while nipping the recording medium between a pressure rotary member and a heating rotary member, to thereby cause a developer image transferred to the recording medium to be fixed on the recording medium;

detecting temperatures of a plurality of regions of the pressure rotary member located along an axial direction of the pressure rotary member;

cooling the regions of the pressure rotary member subjected to the temperature detection; and controlling the cooling to, if a temperature difference between the regions of the pressure rotary member subjected to the detection is more than a set temperature difference which is a preset temperature difference, execute first cooling for reducing the temperature difference between the regions of the pressure rotary member to be equal to or less than the set temperature difference, and to, if a width of the recording medium perpendicular to a transport direction of the recording medium used in an immediately previously executed image formation is equal to or less than a preset width, execute, subsequently to the first cooling, second cooling for cooling the pressure rotary member for a preset time.

* * * * *